US008408532B2

(12) United States Patent
Higaki et al.

(10) Patent No.: US 8,408,532 B2
(45) Date of Patent: Apr. 2, 2013

(54) IMAGE FORMING APPARATUS

(75) Inventors: Hideto Higaki, Yokohama (JP); Manabu Nonaka, Chigasaki (JP); Tsugunao Toyooka, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 34 days.

(21) Appl. No.: 12/923,091

(22) Filed: Sep. 1, 2010

(65) Prior Publication Data

US 2011/0062651 A1 Mar. 17, 2011

(30) Foreign Application Priority Data

Sep. 14, 2009 (JP) ..... 2009-211289

(51) Int. Cl.
*B65H 3/16* (2006.01)

(52) U.S. Cl. ..... 271/18.1; 271/18.2; 271/193

(58) Field of Classification Search ..... 271/193, 271/18.1, 18.2
See application file for complete search history.

(56) References Cited

U.S. PATENT DOCUMENTS 5,971,389 A * 10/1999 Golicz et al. ..... 271/34
7,393,097 B2 * 7/2008 Nakashima et al. ..... 347/104

FOREIGN PATENT DOCUMENTS

JP 05-139548 A 6/1993
JP 2003-160242 A 6/2003
JP 3862577 B2 8/2003
JP 2003237960 A * 8/2003

OTHER PUBLICATIONS

English language abstract of JP-2003237958 published Aug. 27, 2003 which corresponds to JP-3862577-B2.

* cited by examiner

*Primary Examiner* — Michael McCullough
*Assistant Examiner* — Howard Sanders
(74) *Attorney, Agent, or Firm* — Harness, Dickey & Pierce, P.L.C.

(57) ABSTRACT

An image forming apparatus includes an image forming device, a sheet feeding unit, a belt pressing member, and a moving unit. The sheet feeding unit includes an endless, dielectric belt to contact and attract the uppermost sheet to a surface thereof and feed in a sheet feeding direction, and an electric potential pattern forming unit to form an electric potential pattern on a surface of the dielectric belt. The moving unit moves the belt pressing member between a sheet attracting position and a sheet feeding position. The dielectric belt attracts the uppermost sheet at the sheet attracting position, the moving unit moves the belt pressing member to the sheet feeding position, and an entire flat portion of the dielectric belt feeds the uppermost sheet in the sheet feeding direction while carrying the uppermost sheet thereon as the dielectric belt rotates.

13 Claims, 8 Drawing Sheets

IMAGE FORMING APPARATUS

CROSS-REFERENCE TO RELATED APPLICATIONS

The present patent application claims priority pursuant to 35 U.S.C. §119 from Japanese Patent Application No. 2009-211289, filed on Sep. 14, 2009 in the Japan Patent Office, which is hereby incorporated by reference herein in its entirety.

BACKGROUND OF THE INVENTION

1. Field of the Invention

Exemplary embodiments of the present patent application relate to an image forming apparatus that incorporates a sheet feeding unit in which an uppermost sheet placed on a sheet stack is attracted to the surface of a dielectric belt by the action of an electric field generated by electric potential patterns formed on the surface of the dielectric belt and fed in a sheet feeding direction as the dielectric belt rotates.

2. Discussion of the Related Art

Related-art image forming apparatuses, such as copiers, facsimile machines, printers, or multifunction printers having at least one of copying, printing, scanning, and facsimile functions, typically form an image on a sheet of recording media according to image data. Thus, for example, a sheet feeding unit feeds a plurality of sheets one by one toward an image forming device. The image forming device forms an image on a sheet fed from the sheet feeding device.

The sheet feeding device incorporated in such related-art electrophotographic or inkjet image forming apparatuses often use a friction feed method by including a friction member to separate an uppermost sheet from other sheets of the sheet stack loaded in a sheet cassette. Specifically, the friction member, made of rubber having a high friction coefficient, pressingly contacts the uppermost sheet to separate the uppermost sheet from other sheets and conveys it as appropriate. One problem with such an arrangement is that the high friction coefficient of the friction member, which is necessary to feed the sheets to the image forming device in a stable manner, may deteriorate over time or according to environmental conditions, degrading feeding performance of the sheet feeding unit.

Further, when the image forming apparatus is used as a printer, it handles various types of recording media, such as plain paper, coated paper, and label paper. With recording media having a substantially small friction coefficient, sheets providing friction that varies depending on temperature, or sheets absorbing moisture and adhering to each other, the friction member of the sheet supplier may not separate the uppermost sheet from other sheets properly.

Further still, with recording media such as adhesive labels, the surface portion of the sheet can be easily separated from the underlying base layer of the sheet by the frictional force exerted between the pickup member and the recording medium, hindering reliable pick-up of the recording medium by the friction feeding method.

To address the above-described drawback, the image forming apparatus can employ an electrostatic sheet feed method in which recording media are electrically attracted to the surface of a dielectric belt by the action of an electric field generated by electric potential patterns formed on the surface of the dielectric belt and separated from a stack of recording media one by one as the dielectric belt rotates.

In the electrostatic sheet feed method, the electric potential patterns formed on the surface of the dielectric belt generate a non-uniform electric field at an interface between the surface of the dielectric belt and the upper surface of the sheet stack. The non-uniform electric field exerts a force of attraction in a normal direction of the interface based on Maxwell stress to convey the uppermost sheet placed atop the sheet stack as the dielectric belt rotates while attracting the uppermost sheet to the surface of the dielectric belt.

As an example of the electrophotographic image forming apparatus that employs such an electrostatic sheet feed method, Japanese Patent Application Publication No. 2003-237958 (JP-2003-237958-A1) has been proposed.

With the electrophotographic sheet feed method, if the uppermost sheet is picked up from the sheet stack on contacting the dielectric belt, several subsequent upper sheets including a second uppermost sheet are also sometimes picked up together with the uppermost sheet by the dielectric belt by action of an electric field generated by potential patterns formed on the dielectric belt. Therefore, the dielectric belt remains contacted with the sheet stack for a predetermined period of time from the moment the dielectric belt contacts the sheet stack before separating from the sheet stack, thus decreasing the action of the electric field on the second uppermost sheet, which in turn enables the uppermost sheet to be separated from the sheet stack. However, it is known that, for various reasons, the force of attraction is generated at the contact portion between the uppermost sheet and the second uppermost sheet even after the predetermined period of time elapses, and is consequently exerted over the uppermost sheet and the second uppermost sheet substantially to pick them up together.

To tackle the above-described drawback, JP-2003-237958-A discloses a sheet feeding device having a configuration in which the surface of the dielectric belt is effectively separated from the surface of the sheet stack to cause the dielectric belt to slope upward with respect to the surface of the sheet stack after attracting the uppermost sheet to the surface of the dielectric belt contacting the sheet stack.

In this configuration, as the dielectric belt moves away from the sheet stack, the uppermost sheet that is attracted to the surface of the dielectric belt is picked up from the sheet stack. At this time, although the second uppermost sheet is likely to follow the uppermost sheet, the rigidity of the second uppermost sheet provides a force of detachment for separating the second uppermost sheet from the uppermost sheet. Generally, the force of detachment is greater than the force of attraction at the contact portion between the uppermost sheet and the second uppermost sheet due to various reasons. Consequently, even if a force of attraction is generated, the uppermost sheet can be picked up successfully without being followed by the second uppermost sheet.

With the action of detachment, a space is formed in the contact portion between the uppermost sheet and the second uppermost sheet. Once this space is formed, it is easy to separate the uppermost sheet and the second uppermost sheet. Therefore, even if the force of attraction is generated at the contact portion between the uppermost sheet and the second uppermost sheet, the uppermost sheet can separate from the second uppermost sheet successfully.

(In this specification, the terms "pick-up operation" and "picking up" refers to the action or operation in which the dielectric belt attracts the uppermost sheet of the sheet stack thereto to bring the uppermost sheet upward and crate a gap between the uppermost sheet and the immediately underlying, adjacent sheet (i.e., the second uppermost sheet).)

However, in related-art sheet feeding devices for handling sheets including the above-described sheet feeding device disclosed in JP-2003-237958-A, a tensioned flat portion of the dielectric belt cannot form a sufficient angle with respect to the surface of the sheet stack (hereinafter "sheet pick-up angle") when feeding the uppermost sheet that is attracted to the dielectric belt as the dielectric belt rotates. This is important because the greater sheet pick-up angle, the greater the restoring force that tends to restore the second uppermost sheet to its original flat shape. Consequently, the force of detachment generated by the sheet pick-up operation in which the second uppermost sheet is separated from the uppermost sheet also increases. Therefore, the related-art sheet feeding devices having a smaller sheet pick-up angle cannot provide a sufficient force of detachment to separate the second uppermost sheet from the uppermost sheet reliably.

SUMMARY OF THE INVENTION

The present patent application provides a novel image forming apparatus capable of forming a greater sheet pick-up angle and easily providing a sufficient flat portion for securing the force of attraction of the dielectric belt to the uppermost sheet when the greater sheet pick-up angle is obtained.

In one exemplary embodiment, an image forming apparatus includes an image forming device to form an image on a surface of a sheet, a sheet feeding unit to feed the sheet to the image forming device, a belt pressing member, and a moving unit. The image forming device forms an image on a surface of a sheet. The sheet feeding unit feeds the sheet to the image forming device and includes an endless, dielectric belt and an electric potential pattern forming unit. The dielectric belt is disposed facing an upper surface of a sheet stack including an uppermost sheet of multiple sheets to contact and attract the uppermost sheet to a surface thereof and feed in a sheet feeding direction as the dielectric belt rotates. The electric potential pattern forming unit forms an electric potential pattern on a surface of the dielectric belt having multiple potential holding sections of opposite polarities disposed adjacent to each other. The belt pressing member is movably disposed in contact with an inner loop of a flat portion of the dielectric belt to press the dielectric belt outwardly. An outer surface of the flat portion of the dielectric belt faces and contacts the upper surface of the sheet stack. The moving unit moves the belt pressing member between a sheet attracting position, at which an upstream part of the flat portion of the dielectric belt faces parallel to the upper surface of the sheet stack while being pressed outwardly by the belt pressing member, and a sheet feeding position, at which the entire flat portion of the dielectric belt is maintained flat. The upstream part of the flat portion of the dielectric belt attracts a leading area of the uppermost sheet at the sheet attracting position, the moving unit moves the belt pressing member to the sheet feeding position, and the entire flat portion of the dielectric belt feeds the uppermost sheet in the sheet feeding direction while carrying the uppermost sheet thereon as the dielectric belt rotates.

The flat portion of the dielectric belt may be tensioned by multiple supporting members including a first supporting member fixedly disposed to rotate the dielectric belt and a second supporting member movably disposed downstream from the first supporting member in the sheet feeding direction and rotated with the first supporting member. The image forming apparatus may further include a position changing mechanism to change a position of at least one of the multiple supporting members other than the first supporting member to retain a constant length of the dielectric belt as the belt pressing member moves between the sheet attracting position and the sheet feeding position.

The position changing mechanism may change the position of the second supporting member disposed downstream from the first supporting member.

The position changing member may move the second supporting member in the sheet feeding direction.

The position changing mechanism may include a biasing member to urge the second supporting member to a downstream side in the sheet feeding direction, a first guide member to guide the second supporting member to move between the sheet attracting position and the sheet feeding position, and a second guide member to guide the belt pressing member to move between the sheet attracting position and the sheet feeding position. The second supporting member may slidably move along the first guide member as the belt pressing member moves along the second guide member between the sheet attracting position and the sheet feeding position to retain the constant length of the dielectric belt.

The above-described image forming apparatus may further include a sub feeding member disposed at a substantially downstream end of the flat portion of the dielectric belt, to rotate with the dielectric belt while the uppermost sheet is sandwiched between the sub feeding member and the dielectric belt.

The belt pressing member may rotate with the dielectric belt and contact the inner loop of the dielectric belt when the moving unit moves the belt pressing member to the sheet feeding position.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
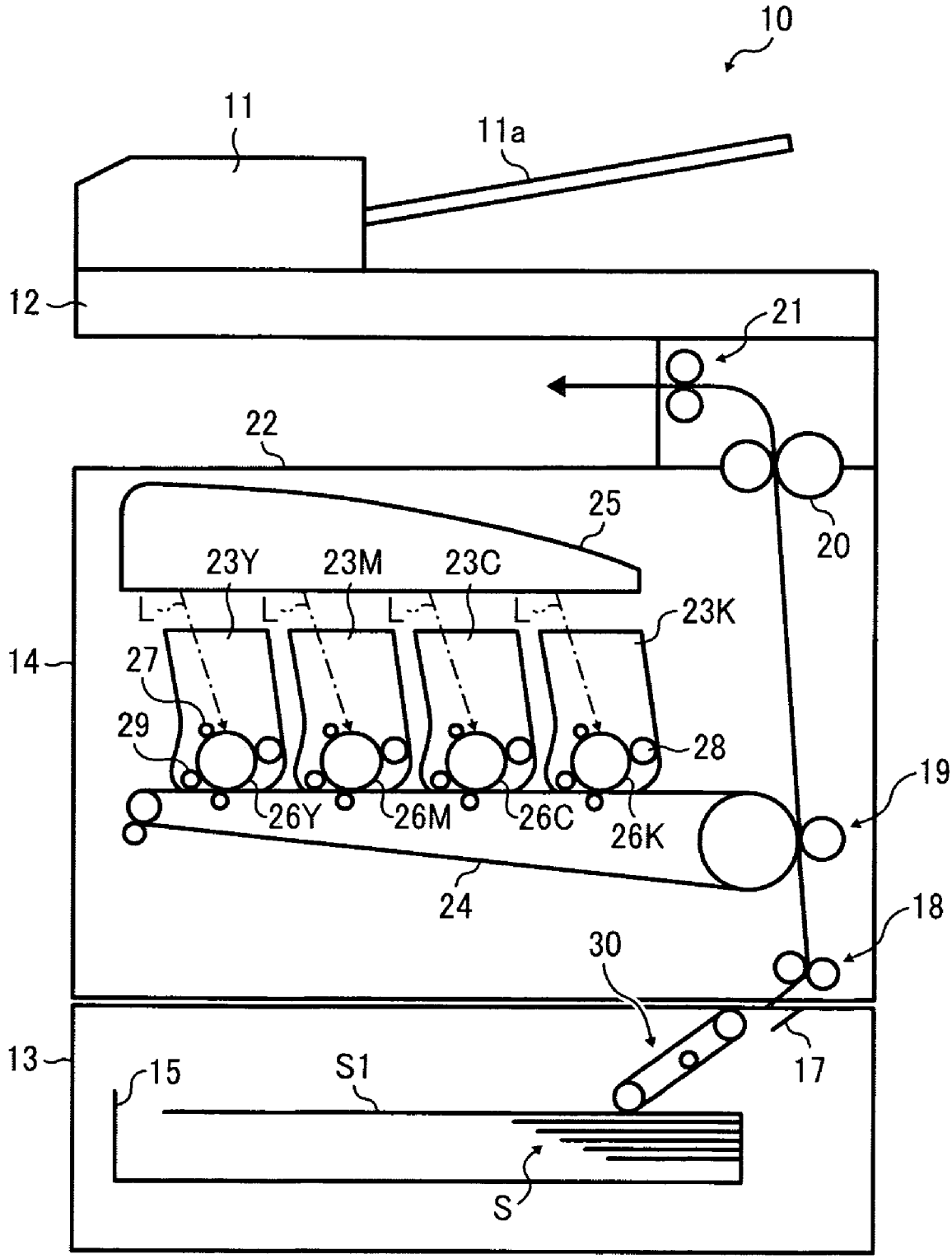
FIG. 1 is a schematic view of an image forming apparatus including a sheet feeding device, according to the present patent application.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present patent application.

The terminology used herein is for the purpose of describing particular embodiments only and is not intended to be limiting of the present patent application. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present patent application. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present patent application.

The present patent application includes a technique applicable to any image forming apparatus, and is implemented in the most effective manner in an electrophotographic image forming apparatus.

In describing preferred embodiments illustrated in the drawings, specific terminology is employed for the sake of clarity. However, the disclosure of the present patent application is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present patent application are described.

FIG. 1 is a schematic view of the image forming apparatus 10 according to an exemplary embodiment of the present patent application.

In FIG. 1, the image forming apparatus 10 includes an automatic document feeder (hereinafter referred to as an "ADF") 11, a document reader 12, a sheet supplying device 13, an image forming device 14, a pair of registration rollers 18, a transfer roller 19, a fixing unit 20, a pair of sheet discharging rollers 21, and a sheet discharging tray 22.

As illustrated in FIG. 1, the image forming apparatus 10 may be a copier, a facsimile machine, a printer, a multifunction printer having at least one of copying, printing, scanning, plotter, and facsimile functions, or the like. The image forming apparatus 10 may form an image by an electrophotographic method, an inkjet method, or any other suitable method. According to this exemplary embodiment, the image forming apparatus 10 functions as a copier for forming an image on a recording medium by the electrophotographic method.

The ADF 11 is mounted on the document reader 12. The ADF 11 includes a document sheet tray 11*a* to hold a sheet stack thereon. The ADF 11 separates each sheet one by one from the sheet stack on the document sheet tray 11*a* to automatically feed the separated sheet to the document reader 12.

The document reader 12 reads image data of the sheet fed from the ADF 11 on a contact glass mounted thereon.

The sheet supplying device 13 that serves as a sheet feeding device is disposed below the image forming device 14. The sheet supplying device 13 accommodates a sheet stack S or recording media therein to supply an uppermost sheet S1 that is picked up from the sheet stack, to the image forming device 14.

The image forming device 14 forms an image on the uppermost sheet S1 supplied by the sheet supplying device 13 according to the image data read in the document reader 12.

According to this exemplary embodiment, the image forming device 14 can separate from the sheet supplying device 13 for supplying the uppermost sheet S to the image forming device 14.

The uppermost sheet S1 separated by the sheet cassette 15 travels in a conveyance path 17 that passes through a nip formed between a nip formed between the pair of registration rollers 18, and a secondary transfer nip formed between the transfer roller 19 and a roller facing the transfer roller 19 with an intermediate transfer belt 24 interposed therebetween.

Through the conveyance path 17, the uppermost sheet S1 is conveyed forward by the pair of registration rollers 18, and receives a toner image formed in the image forming device 14 at the secondary transfer nip of the transfer roller 19. The toner image is then fixed to the uppermost sheet S1 in the fixing unit 20 by application of heat and pressure, and is finally discharged to the sheet discharging tray 22 by the pair of sheet discharging rollers 21.

The image forming device 14 includes four image forming units 23 (specifically, an image forming unit 23Y for forming yellow toner image, an image forming unit 23C for forming cyan toner image, an image forming unit 23M for forming magenta toner image, and an image forming unit 23K for forming black toner image), the intermediate transfer belt 24 that serves as an intermediate transfer member, and an optical writing device 25.

The optical writing device 25 receives color separation image data transmitted from an external device such as a personal computer or a word processor and image data of original documents read by the document reader 12 and converts the image data to a signal for light source driving. Accordingly, the optical writing device 25 drives a semiconductor laser in each laser light source unit and emits light beams L.

The image forming units 23Y, 23C, 23M, and 23K form respective single-color toner images different from each other. The image forming units 23Y, 23C, 23M, and 23K include a photoconductor 26 (specifically, a photoconductor 23Y for carrying yellow toner image thereon, a photoconductor 26C for carrying cyan toner image thereon, a photoconductor 26M for carrying magenta toner image thereon, and a photoconductor 26K for carrying black toner image thereon), and image forming components disposed around the photoconductor 26. The image forming components included in each of the image forming units 23Y, 23C, 23M, and 23K shown in FIG. 1 are a charging unit 27, a developing unit 28, and a cleaning unit 29.

The photoconductor 26 is a cylindrical image carrier that is rotated by a drive source, not illustrated, in a clockwise direction in FIG. 1. The photoconductor 26 has a photoconductive layer as an outer surface thereof.

The charging unit 27 is disposed contacting the photoconductor 26 to uniformly charge the outer surface of the photoconductor 26. The charging unit 27 according to this exemplary embodiment employs a contact-type charging method in which a charging member such as a charging roller uniformly charges the outer surface of the photoconductor 26 by contacting or nearly contacting the outer surface of the photoconductor 26. However, a charging method is not limited thereto.

The light beams L or light spots emitted by the optical writing device 25 irradiate the outer surface of the photoconductor 26 to optically write an electrostatic latent image according to image data.

The developing unit 28 supplies toner to the outer surface of the photoconductor 26 to develop the electrostatic latent image into a visible toner image. In this exemplary embodiment, a non-contact type developing unit that does not directly contact the photoconductor 26 is employed.

The cleaning unit 29 is a brush-contact-type unit in which a brush member thereof is disposed slidably contacting the outer surface of the photoconductor 26 to remove residual toner remaining on the outer surface of the photoconductor 26.

The intermediate transfer belt 24 is an endless belt member including a resin film or a rubber material. The toner image is transferred from the photoconductor 26 onto a surface of the intermediate transfer belt 24 before being further transferred onto the uppermost sheet S1 at the secondary transfer nip formed by the transfer roller 19.

The uppermost sheet S1 having the toner image thereon is conveyed to the fixing unit 20 to be fixed to the uppermost sheet S1 by application of heat and pressure, and is finally discharged to the sheet discharging tray 22 by the pair of sheet discharging-rollers 21.

Figure 2:
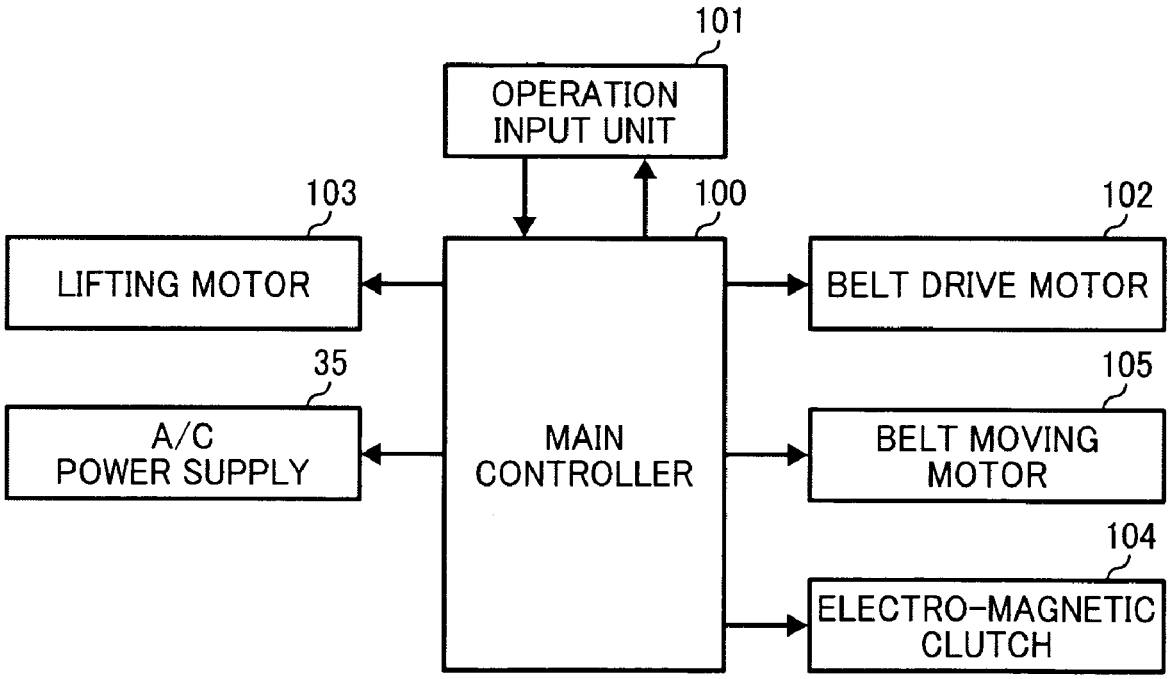
FIG. 2 is a block diagram illustrating a configuration of a control unit of the image forming apparatus shown in FIG. 1.

FIG. 2 is a block diagram illustrating a configuration of a control unit 100 provided to the image forming apparatus 10 according to an exemplary embodiment of the present patent application.

As illustrated in FIG. 2, the control unit 100 is a microcomputer that includes a central processing unit (CPU), a read-only memory (ROM), a random access memory (RAM), an input and output (I/O) interface, and the like.

The control unit 100 shown in FIG. 2 is connected to an operation input unit 101, a belt drive motor 102, a lifting motor 103, an electro-magnetic clutch 104, a belt moving motor 105, an alternating current (A/C) power supply 35, and other unillustrated various sensors and motors provided to the image forming apparatus 10.

The control unit 100 controls operations of the belt drive motor 102, the lifting motor 103, the electro-magnetic clutch 104, and the belt moving motor 105 according to signals inputted from the operation input unit 101, and so forth.

The operation input unit 101 is provided in the image forming apparatus 10 and includes various keypads such as a numeric keypad and a print start keypad, and various indicators. A user inputs sheet information such as material and size of a sheet directly or selects the sheet information via selection buttons through the operation input unit 101 when feeding the sheet by a sheet cassette 15, which will be described below. The sheet information inputted or selected by the user is converted to a signal and is outputted to the control unit 100.

The belt drive motor 102 rotates a drive roller 31 included in the sheet supplying device 13 according to the input signal from the control unit 100. The details of the drive roller 31 will be described below.

The lifting motor 103 moves a contact and separation mechanism 40, details of which are described below, in a vertical direction, according to the input signal from the control unit 100.

The electro-magnetic clutch 104 is disposed between the belt drive motor 102 and the drive roller 31 and switches between opening (transmitting) and closing (blocking) the power source between the belt drive motor 102 and the drive roller 31 according to the input signal from the control unit 100.

The belt moving motor 105 drives a belt pressing roller 36, which will be described later.

The A/C power supply 35 supplies a charging voltage to a charging roller, described below, according to the input signal from the control unit 100.

Figure 3:
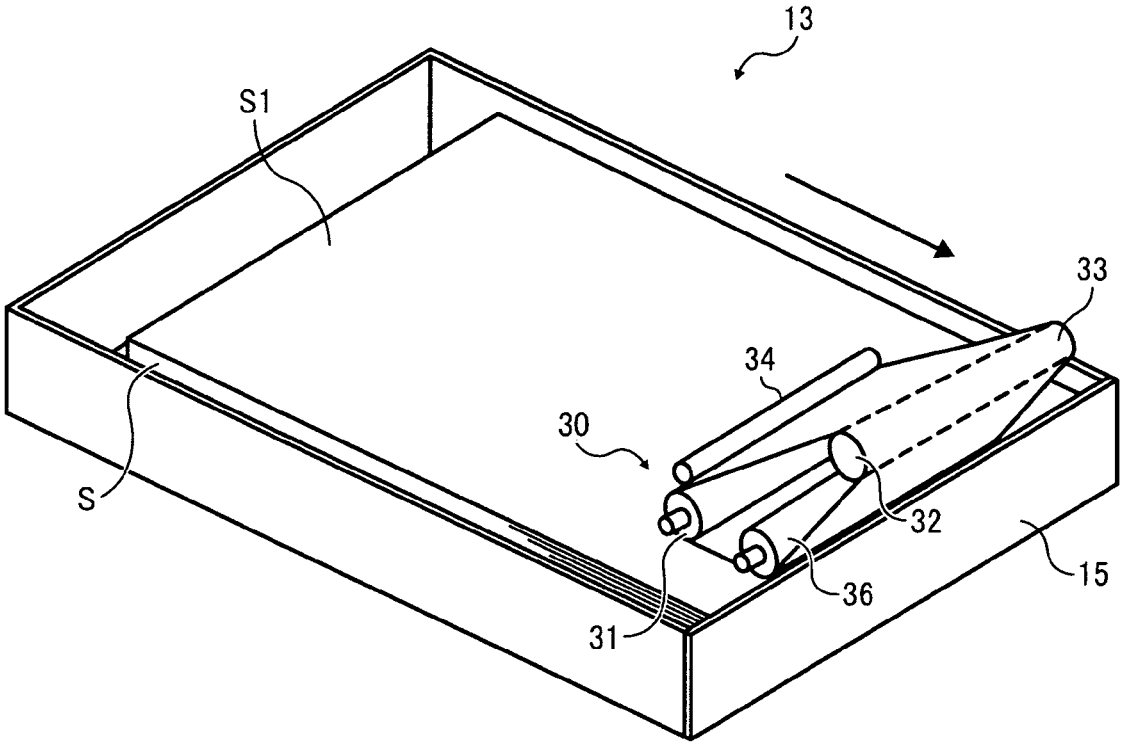
FIG. 3 is a perspective view of the sheet feeding device incorporated in the image forming apparatus shown in FIG. 1, according to the present patent application.
Figure 4:
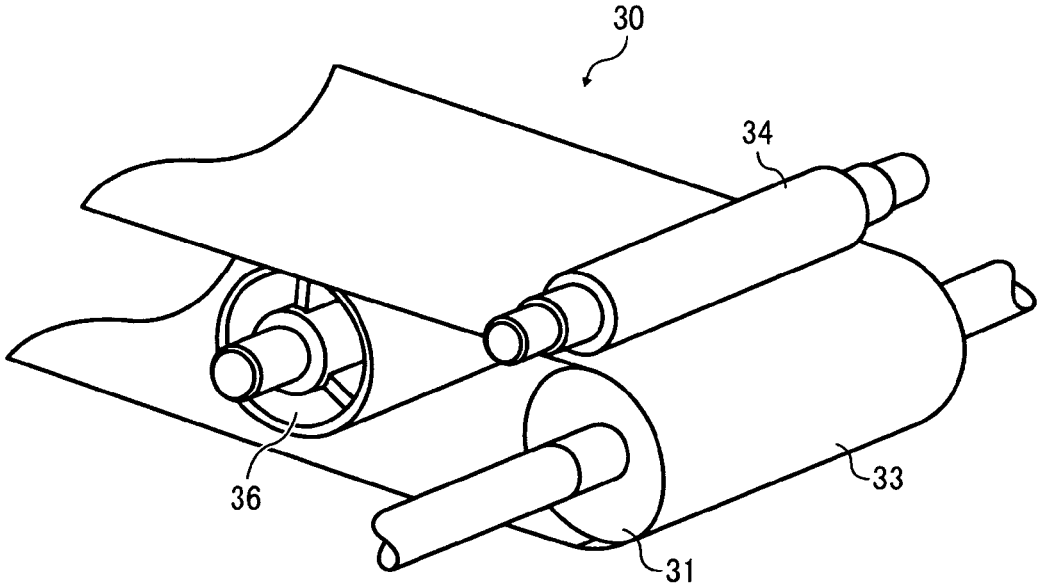
FIG. 4 is a perspective view of a sheet separation feeder according to the preset patent application.

FIG. 3 is a perspective view of the sheet supplying device 13 incorporated in the image forming apparatus 10 and FIG. 4 illustrates a schematic configuration of the sheet feeder 30.

As illustrated in FIG. 3, the sheet supplying device 13 includes the sheet cassette 15 and a sheet feeder 30. The sheet cassette 15 serves as a sheet container and loads the sheet stack S therein to attract the uppermost sheet S1 placed on top of the sheet stack S to the sheet feeder 30 and pick up and feed the uppermost sheet S1 from the sheet stack S.

The uppermost sheet S1 separated by the sheet feeder 30 travels in the conveyance path 17 that passes through the nip formed between the pair of conveyance rollers 18 and the secondary transfer nip formed between the transfer roller 19 and a roller facing the transfer roller 19 with the intermediate transfer belt 24 interposed therebetween. The conveyance path 17 is defined by an upper guide plate 17*b* and a lower guide plate 17*a* provided downstream from the drive roller 31 in the sheet feeding direction.

As illustrated in FIG. 3, the sheet feeder 30 is disposed above the sheet cassette 15 and employs an electrostatic sheet feed method in which the uppermost sheet S1 is picked up from the sheet stack S by being attracted by a charged dielectric belt 33, which will be described below. A width along an axial direction of the sheet feeder 30 is narrower or smaller than that of any sheet that can be loaded in the sheet cassette 15 and is disposed in the vicinity of the latitudinal center in the width direction of the loadable sheet. Alternatively, the width of the sheet feeder 30 can be equal to or greater than that of any loadable sheet. Further, two or more sheet separation feeders 30 can be disposed along the width of any loadable sheet while one sheet feeder 30 is provided in the vicinity of the latitudinal center in the width of the uppermost sheet S1 in the sheet supplying device 13 in FIG. 3.

As illustrated in FIG. 4, the sheet feeder 30 includes the drive roller 31, the driven roller 32, the dielectric belt 33, and a charging roller 34.

The drive roller 31 serves as an upstream supporting member and the driven roller 32 serves as a downstream supporting member. The dielectric belt 33 according to this exemplary embodiment is looped over the drive roller 31 and the driven roller 32.

The charging roller 34 is an electrode extending along the width of the dielectric belt 33. The charging roller 34 contacts the surface of the dielectric belt 33 to serve as an electric potential pattern forming unit to form predetermined electric potential pattern on the surface of the dielectric belt 33.

Figure 5:
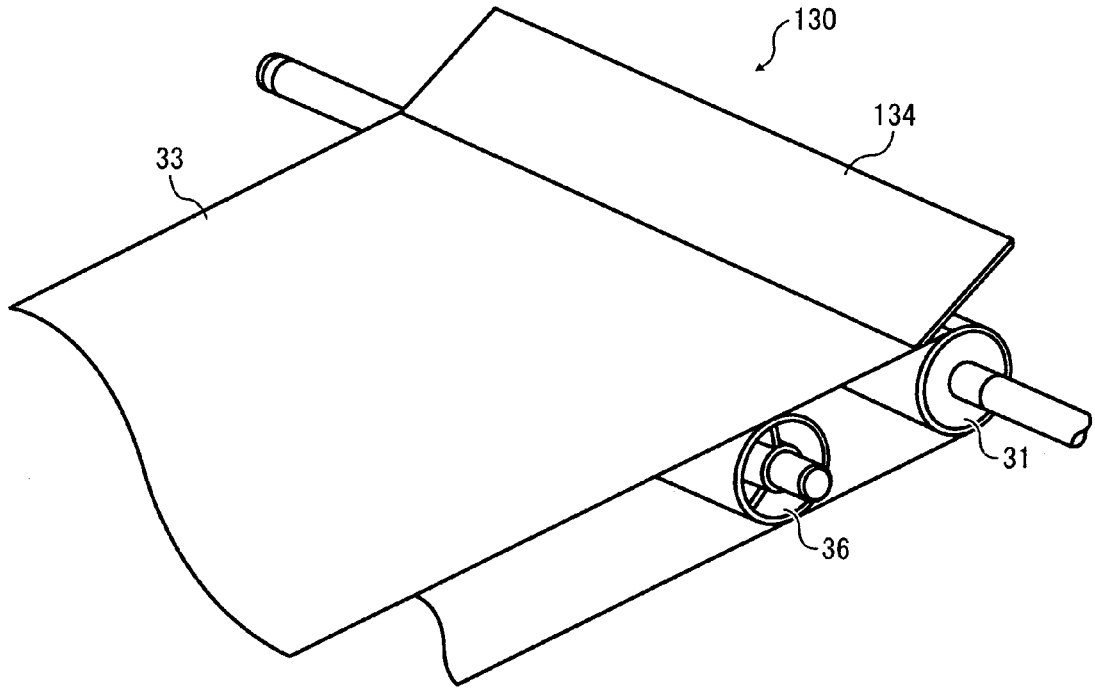
FIG. 5 is a perspective view of a modification of the sheet separation feeder shown in FIG. 4, according to the present patent application.

In this exemplary embodiment, the charging roller 34 is employed as an electric potential pattern forming unit. However, as shown in FIG. 5, a modified sheet feeder 130 can employ a blade-type charging member 134 as the electric potential pattern forming unit.

Figure 6:
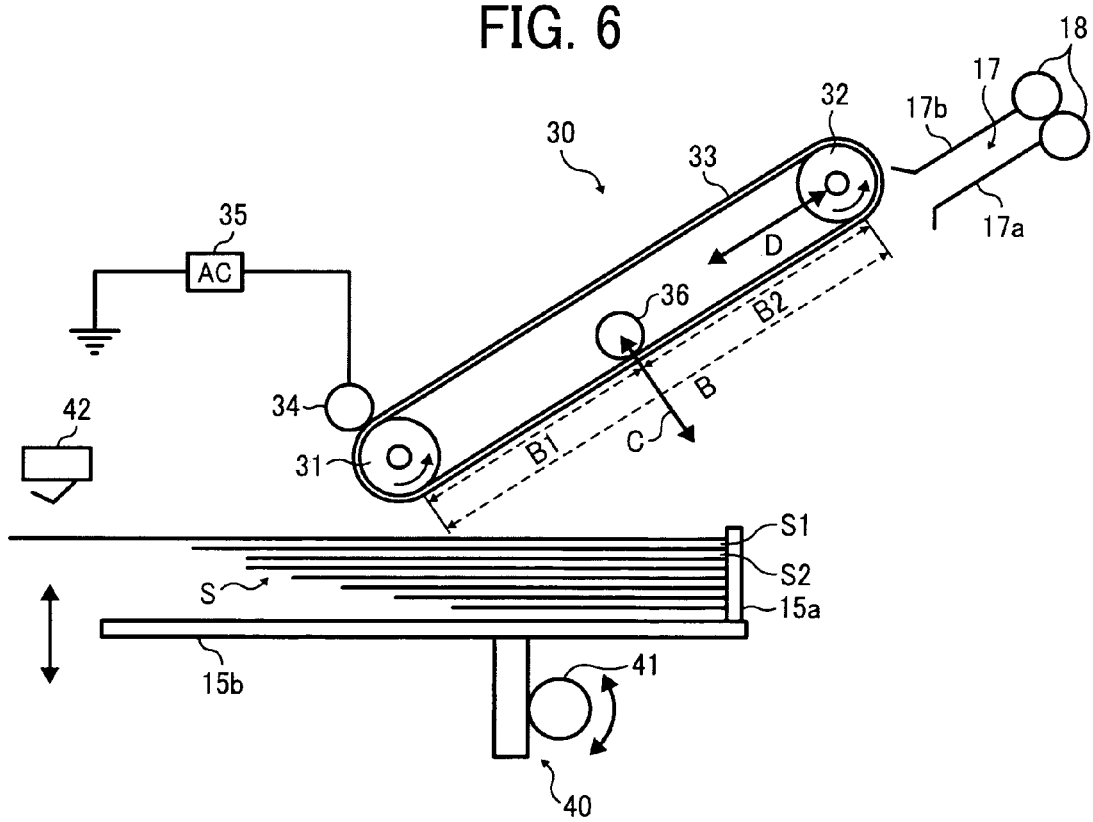
FIG. 6 is a side view of the sheet feeding device shown in FIG. 1, according to the present patent application.

FIG. 6 illustrates a schematic configuration of the sheet feeder 30 and other units in the sheet supplying device 13.

As illustrated in FIG. 6, the dielectric belt 33 according to this exemplary embodiment is looped over the drive roller 31 and the driven roller 32. The dielectric belt 33 has a multilayer construction that includes a front layer 33*a* having a resistivity of about $10^8$ Ω·cm or greater (for example, a polyethylene terephthalate film having a thickness of about 100 μm), and a back layer 33*b* having a resistivity of about $10^6$ Ω·cm or smaller to maintain a good charging state.

The dielectric belt 33 is not limited to have a double-layer structure but may have a single-layer structure or a structure having three or more layers. The charging roller 34 can be disposed at any position on the front layer 33*a*. Further, the dielectric belt 33 can be disposed at any position facing the sheet stack S where it is possible to obtain a sufficient area on the surface for attracting the sheet stack S, and the surface of the sheet stack S contacts the leading edge area or the downstream area of the uppermost sheet S1 in the sheet feeding direction.

An outer surface of the drive roller 31 includes a conductive rubber layer having a resistivity of about $10^6$ Ω·cm. An inner part of the conductive rubber layer of the drive roller 31 includes a rubber material having a resistivity of about $10^6$ Ω·cm. Both the surface and the inner part of the driven roller 31 include metal. The driven roller 32 rotates with rotation of the dielectric belt 33 that is driven by the drive roller 31. It is to be noted that the drive roller 31 and the driven roller 32 are electrically grounded. The driven roller 32 has a small diameter suitable to remove the uppermost sheet S1 from the dielectric belt 33 by a curvature of the dielectric belt 33. For example, the great curvature caused by the small diameter of the driven roller 32 separates the uppermost sheet S1 attracted by the dielectric belt 33 from the surface of the dielectric belt 33 looped over the driven roller 32, and the dielectric belt 33 driven by the drive roller 31 feeds the removed uppermost sheet S1 toward the conveyance path 17 that is defined by the upper guide plate 17*b* and the lower guide plate 17*a* provided downstream from the drive roller 31 in the sheet feeding direction.

The charging roller 34 is disposed to contact the outer surface of the dielectric belt 33 in the vicinity of which the dielectric belt 33 is looped over the drive roller 31. The charging roller 34 is connected to the A/C power supply 35 that generates alternating current. The voltage to be applied to the charging roller 34 can be any alternating voltage such as a voltage formed by sine waves. Further, instead of the alternating current, the charging power supply 35 may apply a direct current in which high and low potentials are alternately provided. According to this example embodiment, the charging power supply 35 applies an alternating current having amplitude of about 4 KV to the surface of the dielectric belt 33.

An electric discharging unit to electrically discharge the charges on the surface of the dielectric belt 33 can be disposed upstream from the charging roller 34 in the belt moving direction in which the lower surface of the dielectric belt 33 facing the uppermost sheet S1 moves and downstream from the sheet separation position where the uppermost sheet S1 separates from the dielectric belt 33.

The sheet cassette 15 that accommodates the sheet stack S includes a side wall 15*a* at the leading area of a sheet in a sheet feeding direction to regulate the leading edge of the sheet stack S.

The sheet feeder 30 according to this exemplary embodiment includes the contact and separation mechanism 40 that serves as a contact and separation unit to contact and separate the dielectric belt 33 and the upper surface of the sheet stack S.

The contact and separation mechanism 40 includes a rack and pinion type sheet pressing member 41 to move a bottom plate 15*b* of the sheet cassette 15 in a vertical direction while the bottom plate 15*b* remains horizontal. In this exemplary embodiment, the contact and separation mechanism 40 moves the sheet stack S vertically but does not move the sheet feeder 30 in the vertical direction. Alternatively, the contact and separation mechanism 40 can move only the bottom plate 15*b* in the vertical direction or move both the bottom plate 15*b* and the sheet feeder 30.

The contact and separation mechanism 40 of this exemplary embodiment further includes a sensor 42 to detect a position of the upper surface of the sheet stack S in the vertical direction. The lifting motor 103 illustrated in FIG. 2 causes the contact and separation mechanism 40 to control vertical movements of the bottom plate 15*b* of the sheet cassette 15 according to detection results obtained by the sensor 42. The contact and separation mechanism 40 further maintains a proper gap between the upper surface of the sheet stack S and the lower surface of the dielectric belt 33 and a suitable contact pressure generated between the dielectric belt 33 and the sheet stack S. Different from a contact pressure employed in the sheet separation method using an existing frictional force, it is sufficient to provide a contact pressure for the dielectric belt 33 that is just enough to contact the upper surface of the sheet stack S in this exemplary embodiment.

As described above, in this exemplary embodiment, the dielectric belt 33 is extendedly supported by the drive roller 31 and the driven roller 32, which forms at least two tensioned, flat portions in the dielectric belt 33. One of the tensioned flat portions faces the upper surface of the sheet stack S, which is hereinafter referred to as a lower flat portion B. In this exemplary embodiment, the driven roller 32 is supported to rotate about the axis of the drive roller 31.

In this exemplary embodiment, the sheet feeder 30 further includes a belt pressing roller 36 that serves as a belt pressing member that contacts the lower flat portion B from the inner loop of the dielectric belt 33. The belt pressing roller 36 is driven by the belt moving motor 105 to move between the sheet feeding position, which is a home position thereof, and the sheet attracting position in a direction indicated by arrow C as indicted in FIG. 6, so that the belt pressing roller 36 can press the dielectric belt 33 outwardly from the home position to the sheet attracting position and return the dielectric belt 33 from the sheet attracting position to the home position. As previously described, the belt moving motor 105 controls the movement of the belt pressing roller 36 in the direction C.

The biased driven roller 32 generates a biasing force from the inner circumference to the outer circumference of the dielectric belt 33, thereby maintaining the dielectric belt 33 extended with the predetermined tension force.

The lower flat portion B of the dielectric belt 33 includes an upstream area ranging in the sheet feeding direction from a downstream contact area where the drive roller 31 contacts the inner loop of the dielectric belt 33 to a contact point where the belt pressing roller 36 contacts the inner loop of the dielectric belt 33 and a downstream area ranging in the sheet feeding direction from the contact point of the belt pressing roller 36 to the dielectric belt 33 to an upstream contact area where the driven roller 32 contacts the inner loop of the dielectric belt 33. Hereinafter, the upstream area is referred to as a "sheet attracting area B1" and the downstream area is referred to as a "sheet carrying area B2".

Next, a detailed description is given of an operation of feeding the uppermost sheet S1.

Figure 7A:
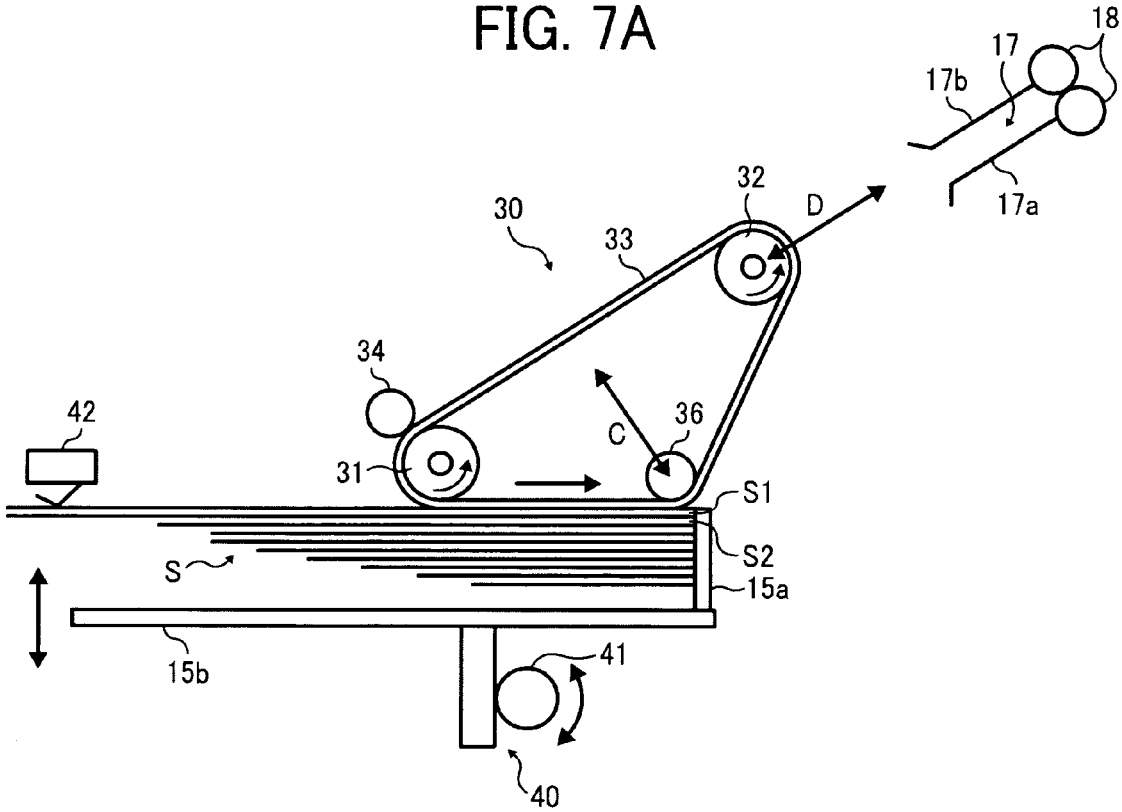
FIG. 7A is a side view of the sheet feeding device of FIG. 6 when a belt pressing roller is at a sheet attracting position.
Figure 7B:
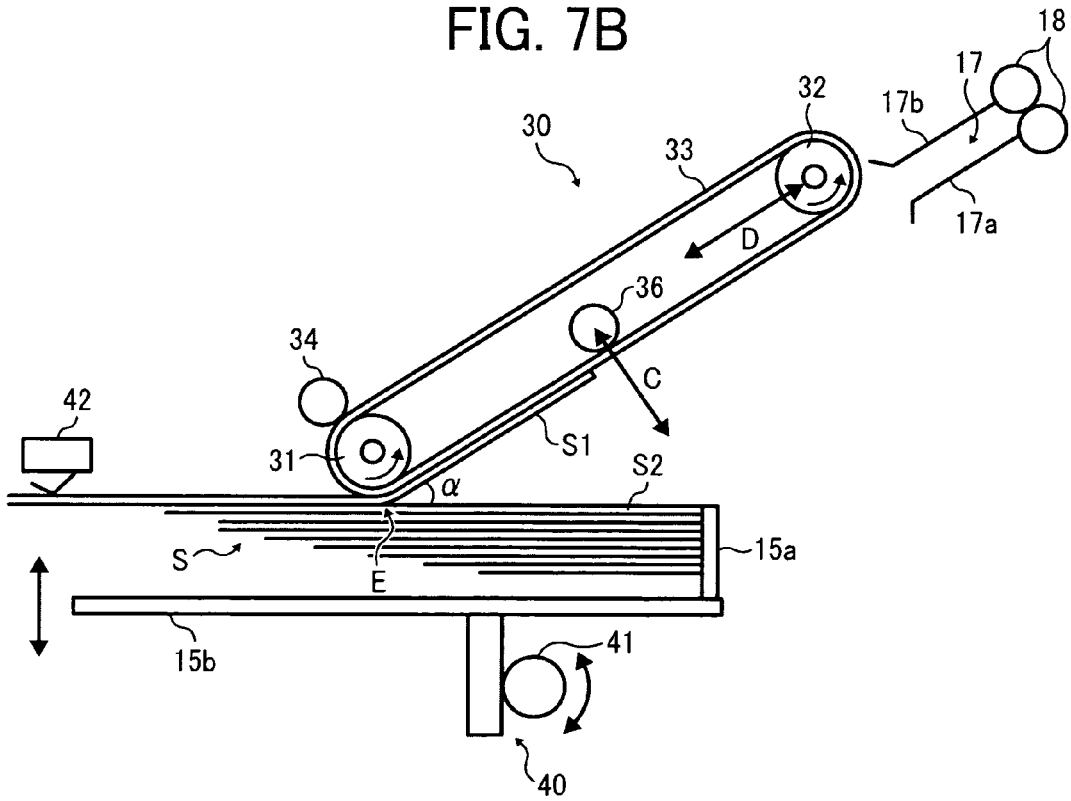
FIG. 7B is a side view of the sheet feeding device of FIG. 6 when the belt pressing roller is at a sheet feeding position.
Figure 7C:
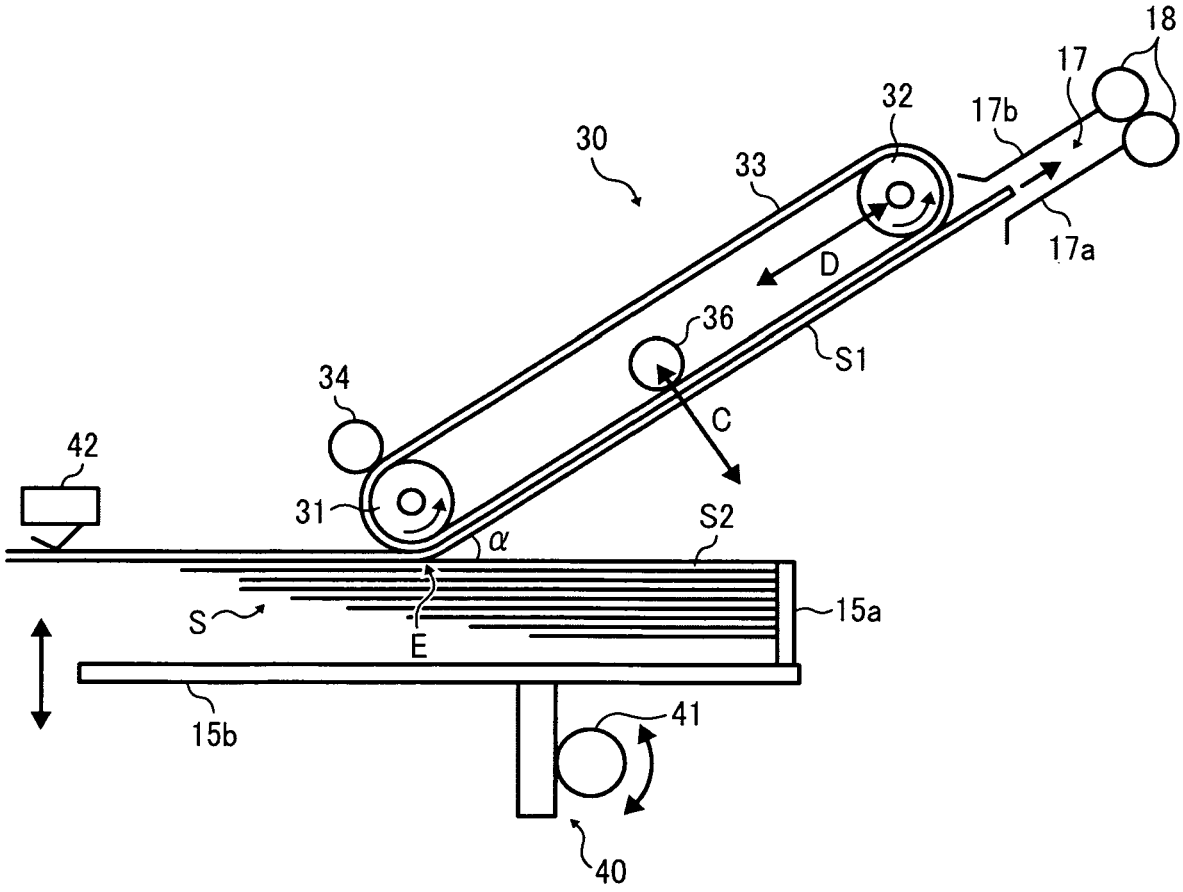
FIG. 7C is a side view of the sheet feeding device of FIG. 6 when the dielectric belt conveys an uppermost sheet attracted thereto toward a conveyance path while picking up the uppermost sheet from the sheet stack.

FIG. 7A illustrates a status of the dielectric belt 33 in which the belt pressing roller 36 is located at the sheet attracting position. FIG. 7B illustrates a status of the dielectric belt 33 in which the belt pressing roller 36 is located at the sheet feeding position. FIG. 7C illustrates a status of the dielectric belt 33 in which the uppermost sheet S1 attracted to the lower flat portion B of the dielectric belt 33 is conveyed toward the sheet conveyance path 17.

When the control unit 100 transmits a sheet feeding signal, the belt pressing roller 36 is located at the sheet feeding position (i.e., the home position) and the electro-magnetic clutch 104 provided to a driving force transmission system of the drive roller 31 is turned on while the dielectric belt 33 and the sheet stack S are not in contact with each other, as illustrated in FIG. 6. This action transmits a driving force to the drive roller 31 to start.

Then, the charging roller 34 that is connected to the A/C power supply 35 applies an alternating voltage to the dielectric belt 33 in rotation. Consequently, the electric potential patterns or the charge patterns of positive potential holding section and negative potential holding section are formed on the surface of the dielectric belt 33, at pitches or intervals determined by the frequency of the A/C power supply 35 and the rotation speed (e.g., the circumferential speed) of the dielectric belt 33. The electric potential patterns or the charge patterns are alternately provided on the front layer 33*a* of the dielectric belt 33 in a direction in which the lower flat portion B of the dielectric belt 33 moves. Namely, the dielectric belt 33 is charged with the alternating voltage. The pitch of a pair of positive potential holding section and negative potential holding section disposed adjacent to each other is preferably in a range of from 2 mm to 15 mm, and more preferably from 2 mm to 4 mm.

When the electric potential pattern is successfully formed at least on the sheet attracting area B1 of the dielectric belt 33, the control unit 100 turns off the electro-magnetic clutch 104 so that the drive roller 31 stops rotating. The control unit 100 then causes the contact and separation mechanism 40 to lower the dielectric belt 33, which is not rotating, to cause the dielectric belt 33 to contact the upper surface of the sheet stack S. At this time, the dielectric belt 33 contacts the upper surface of the sheet stack S at the looped portion of the drive roller 31. Then, the belt pressing roller 36 is moved from the sheet separating position to the sheet attracting position, as shown in FIG. 7A. With this action, the lower flat portion B of the dielectric belt 33 is elbowed or bent outwardly so that the sheet attracting area B1 of the lower, flat portion B can contact the upper surface of the sheet stack S.

When the sheet attracting area B1 of the dielectric belt 33 having the electric potential pattern thereon contacts the upper surface of the sheet stack S, a non-uniform electric field formed by the electric positive and negative charge patterns on the sheet attracting area B1 of the lower flat portion B of the dielectric belt 33 generates Maxwell stress that attracts the uppermost sheet S1 to the dielectric belt 33 and holds it there.

Generally, the force of attraction generated by the electric potential pattern to the dielectric belt 33 is exerted on the uppermost sheet S1, the second uppermost sheet S2, and, in some cases, any subsequent sheets for a predetermined period of time from the moment the dielectric belt 33 contacts the sheet stack S before being picked up from the sheet stack S. However, after the predetermined period of time has elapsed, the force of attraction acts on the uppermost sheet S1 only. Namely, the force of attraction does not act on the second uppermost sheet S2 and other subsequent sheets. Therefore, in theory, the uppermost sheet S1 can be picked up from other sheets in the sheet stack S by waiting for the predetermined time. However, it is known that, in reality, even after the predetermined period of time, the second uppermost sheet S2 can be still picked up together with the uppermost sheet S1 due to various reasons.

In this exemplary embodiment, after the predetermined period of time from the moment the dielectric belt 33 contacts the upper surface of the sheet stack S, the belt pressing roller 36 is moved from the sheet attracting position to the sheet separating position, as shown in FIG. 7B. With this action, the elbowed lower flat portion B of the dielectric belt 33 becomes flat again, so that the sheet attracting area B1 moves away from the upper surface of the sheet stack S. At this time, since the leading area, that is, the downstream area in the sheet feeding direction, of the uppermost sheet S1 remains attracted to the sheet attracting area B1, a space or gap is formed between the leading area of the uppermost sheet S1 and the second uppermost sheet S2, as shown in FIG. 7B. As previously noted, due to various reasons, the force of attraction can remain between the leading area of the uppermost sheet S1 and the leading area of the second uppermost sheet S2 in many cases. However, once a space or gap is formed, a force of detachment is exerted between the leading area of the uppermost sheet S1 and the leading area of the second uppermost sheet S2 by the rigidity and own weight of the second uppermost sheet S2. As a result, the uppermost sheet S1 and the second uppermost sheet S2 can be no longer adhered to each other. Namely, the uppermost sheet S1 and the second uppermost sheet S2 can be separated.

As illustrated in FIG. 7B, when the gap is formed between the leading area of the uppermost sheet S1 and the second uppermost sheet S2, the control unit 100 turns on the electro-magnetic clutch 104 so that the drive roller 31 starts rotating. As the surface of the dielectric belt 33 moves, the A/C power supply 35 forms the electric potential pattern on the surface of the dielectric belt 33. According to the movement of the surface of the dielectric belt 33, the uppermost sheet S1 with the leading area thereof attracted to the dielectric belt 33 is conveyed along the lower flat portion B in the sheet feeding direction. Consequently, by feeding the uppermost sheet S1 as described above, a force generated for conveying the uppermost sheet S1 forward acts as a force of detachment to detach the second uppermost sheet S2 from the uppermost sheet S1. The force of detachment acts at a boundary E formed between a contact portion where the uppermost sheet S1 contacts the second uppermost sheet S2 and the gap where the uppermost sheet S1 is separated from the second uppermost sheet S2 and attracted to the lower flat portion B of the dielectric belt 33. As a result, even if the uppermost sheet S1 and the second uppermost sheet S2 remain in contact with each other at the contact portion, the uppermost sheet S1 can be separated from the second uppermost sheet S2 by using the force of detachment. Namely, in this exemplary embodiment, as shown in FIG. 7C, the uppermost sheet S1 can be conveyed toward the conveyance path 17 while performing the pick-up operation in which only the uppermost sheet S1 is picked up from the sheet stack S.

In this exemplary embodiment, if the force of detachment to detach the uppermost sheet S1 from the second uppermost sheet S2 is increased, a more stable pick-up operation can be achieved. To do so, it is desirable to increase a sheet pick-up angle α formed by the outer surface of the lower flat portion B of the dielectric belt 33 and the upper surface of the sheet stack S when the belt pressing roller 36 is at the sheet feeding position. In this exemplary embodiment, as the sheet pick-up angle α becomes greater, the amount of movement of the belt pressing roller 36 that is needed to cause the sheet attracting area B1 of the lower flat portion B to contact the upper surface of the sheet stack S can also increase. Even if the amount of movement of the belt pressing roller 36 increases, the layout of the sheet feeder 30 is flexible, and therefore, it is easy to design the sheet feeder 30 to provide a greater space for the belt pressing roller 36 to move.

Figure 8A:
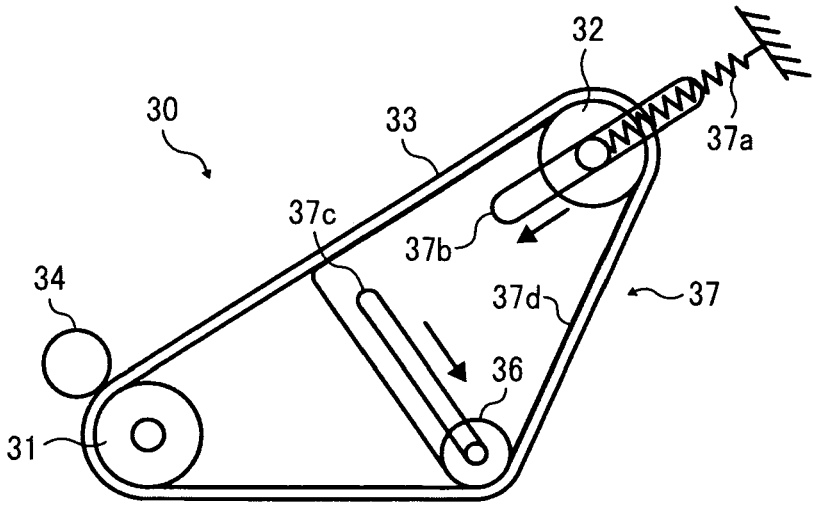
FIG. 8A is an enlarged view of a position changing mechanism in operation shown in FIG. 7A.
Figure 8B:
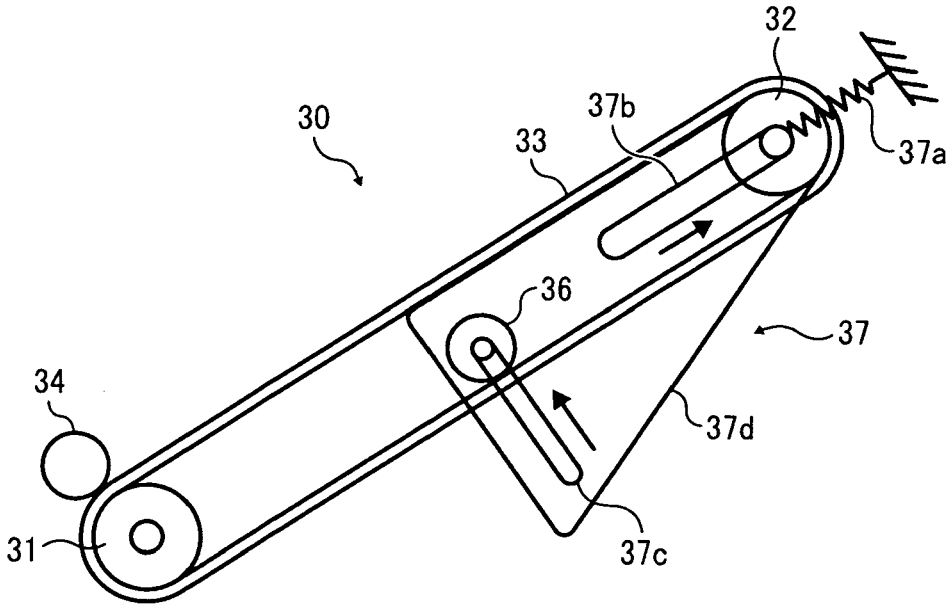
FIG. 8B is an enlarged view of the position changing mechanism in operation shown in FIG. 7B.

FIGS. 8A and 8B illustrate enlarged views of the position changing mechanism 37.

As illustrated in FIGS. 8A and 8B, the position changing mechanism 37 includes a biasing member 37*a*, guide rails 37*b* and 37*c*, and a supporting plate 37*d*. The supporting plate 37*d* supports the range of movement of the guide rails 37*b* and 37*c*.

When the driven roller 32 that also works as a position change supporting member moves as the belt pressing roller 36 moves to adjust the length of the dielectric belt 33, the movement of the driven roller 32 is supported by the position changing mechanism 37. Namely, the driven roller 32 moves along the guide rail 37*b* in a direction D, which corresponds to the sheet feeding direction. The driven roller 32 is biased downstream in the sheet feeding direction by the biasing member 37*a*.

Further, when the belt pressing roller 36 is driven by the belt moving motor 105 to move outward from the sheet feeding position to the sheet attracting position, the belt pressing roller 36 moves along the guide rail 37*c* to press the dielectric belt 33 outward, as illustrated in FIG. 8A. According to the movements of the belt pressing roller 36 and the dielectric belt 33, the driven roller 32 moves to the upstream side of the sheet feeding direction, that is, to the inside space of the loop of the dielectric belt 33 against the biasing force so as to maintain the original length of the circumference of the dielectric belt 33. More specifically, the driven roller 32 moves along the guide rail 37*b* to the upstream side of the sheet feeding direction.

By contrast, as the belt pressing roller 36 is driven by the belt moving motor 105 to move inward from the sheet attracting position to the sheet feeding position, the dielectric belt 33 is moved inward to the sheet feeding position where the entire lower flat portion B of the dielectric belt 33 is maintained flat without pressing the lower flat portion B, as illustrated in FIG. 8B. According to the movement of the dielectric belt 33, the driven roller 32 moves to the downstream side of the sheet feeding direction. In other words, the driven roller 32 is moved to the downstream side of the sheet feeding direction according to the biasing force exerted by the biasing member 37*a*, thereby maintaining the original constant length of the circumference of the dielectric belt 33.

As described above, the driven roller 32 in this exemplary embodiment changes its position according to the movement of the belt pressing roller 36, so that the original length of the circumference of the dielectric belt 33 can remain unchanged before and after the movement of the belt pressing roller 36.

At the same time, this configuration can provide a result in which, when the amount of movement of the lower flat portion B of the dielectric belt 33 to the outward direction increases according to the shift of the belt pressing roller 36 to the sheet attracting position, the amount of positional change of the driven roller 32 also increases. However, when the lower flat portion B of the dielectric belt 33 is pressed outward according to the movement of the belt pressing roller 36, the driven roller 32 can move toward the inner side of the loop of the dielectric belt 33 along the sheet feeding direction D as shown in FIGS. 7A through 8C. The space surrounded by the inner circumference of the dielectric belt 33 is a so-called dead space and not used for any specific purpose, and therefore, by using the configuration according to this exemplary embodiment, the layout of the device is less limited even if the position of the driven roller 32 is changed.

Accordingly, in this exemplary embodiment, when the sheet pick-up angle α is increased to enhance the sheet pick-up performance by the sheet pick-up operation, the amount of movement of the belt pressing roller 36 and/or the amount of positional change of the driven roller 32 can increase. However, the amount of movement of the belt pressing roller 36 or the amount of positional change of the driven roller 32 can be increased easily because of flexibility of the layout of the device. Therefore, a sufficiently large sheet pick-up angle α can be provided, thereby enhancing the sheet pick-up performance by the sheet pick-up operation for a better separation performance.

In addition, when a greater sheet pick-up angle α is provided, the length of the lower flat portion B in the belt surface moving direction may need to be longer so as to secure a following-up property of the uppermost sheet S1 to the dielectric belt 33.

In this exemplary embodiment, a sufficiently long length of the lower flat portion B can be retained by increasing the length of the sheet carrying area B2. Even if the sheet carrying area B2 is increased, only a very slight impact is made on the movement of the belt pressing roller 36 and the size of space in the inner loop of the dielectric belt 33 needed for changing the position of the driven roller 32. Therefore, according to this exemplary embodiment, the following-up property, of the uppermost sheet S1 with respect to the dielectric belt 33 that is needed for the greater sheet pick-up angle α can be easily secured by increasing the length of the lower flat portion B of the dielectric belt 33.

As described above, the image forming apparatus 10 according to this exemplary embodiment of the present patent application includes the image forming device 14 to from an image on the uppermost sheet S1 and the sheet feeder 30 that serves as a sheet feeding unit to feed the uppermost sheet S1 to the image forming device 14. The sheet feeder 30 includes the endless, dielectric belt 33, the charging roller 34, the A/C power supply 35, the belt pressing roller 36, and the belt moving motor 105. The dielectric belt 33 is disposed facing the upper surface of the sheet stack S including the uppermost sheet S1 of multiple sheets to contact and attract the uppermost sheet S1 to the surface thereof and feed in the sheet feeding direction as the dielectric belt 33 rotates. The charging roller 34 and the A/C power supply 35 serve as an electric potential pattern forming unit to form the electric potential pattern on the tensioned, flat portion B of the dielectric belt 33 having multiple potential holding sections of opposite polarities disposed adjacent to each other. The belt pressing roller 36 that serves as a belt pressing member is movably disposed in contact with an inner surface of the flat portion B of the dielectric belt 33 to press the dielectric belt 33 outward. The belt moving motor 105 that serves as a moving unit moves the belt pressing roller 36 between the sheet attracting position, at which the upstream area or sheet attracting area B1 of the flat portion B of the dielectric belt 33 faces parallel to the upper surface of the sheet stack S while being pressed outward by the belt pressing roller 36, and the sheet feeding position, at which the entire flat portion B of the dielectric belt 33 is maintained flat. The sheet attracting area B1 of the flat portion B of the dielectric belt 33 attracts a leading area of the uppermost sheet S1 at the sheet attracting position. The belt moving motor 105 moves the belt pressing roller 36 to the sheet feeding position. The entire flat portion B of the dielectric belt 33 feeds the uppermost sheet S1 in the sheet feeding direction while carrying the uppermost sheet S1 thereon as the dielectric belt 33 rotates.

The above-described configuration can increase the sheet pick-up angle α for a better sheet pick-up performance by the sheet pick-up operation easily. Further, it is easy to obtain the lower flat portion B of the dielectric belt 33 for the following-up property of the uppermost sheet S1 with respect to the dielectric belt 33 that is needed for the greater sheet pick-up angle α.

Specifically, in this exemplary embodiment, the position changing mechanism 37 to change the position of the driven roller 32 that works as the downstream supporting member to support the dielectric belt 33 other than the drive roller 31 that serves as the upstream supporting member. The position changing mechanism 37 changes its position along the guide rail 37*b* as the belt pressing roller 36 moves along the guide rail 37*c*, so that the original length of the circumference of the dielectric belt 33 can remain unchanged before and after the movement of the belt pressing roller 36 controlled by the belt moving motor 105.

Accordingly, a general, non-stretchable dielectric belt can be employed as the dielectric belt 33. In this configuration, when a greater amount of the lower flat portion B of the dielectric belt 33 protrudes outwardly according to the shift of the belt pressing roller 36 to the sheet attracting position, the driven roller 32 further shifts from the sheet separating position toward the inner side of the loop of the dielectric belt 33. However, in this exemplary embodiment, when the lower flat portion B of the dielectric belt 33 is pressed outwardly according to the movement of the belt pressing roller 36, the driven roller 32 can move in the inward direction of the loop of the dielectric belt 33, i.e., the sheet feeding direction D in FIGS. 7A through 8C. Since the inner circumference of the dielectric belt 33 has a large amount of space, the layout of device with respect to the positional change of the driven roller 32 is less limited, that is, has sufficient space to move. Therefore, when an ordinary, non-stretchable dielectric belt is used as the dielectric belt 33, it can be easier to obtain the greater sheet pick-up angle α and the sufficient length of the lower flat portion B of the dielectric belt 33 to secure the following-up property of the uppermost sheet S1 to the dielectric belt 33 that is needed for the greater sheet pick-up angle α.

Further, the driven roller 32 that serves as the downstream supporting member can change position in this exemplary embodiment by sliding along the guide rail 37*b*. Accordingly, only three members are needed to support the dielectric belt 33, namely, the drive roller 31 and the driven roller 32, that serve as the upstream supporting member and the downstream supporting member, respectively, and are located at both ends of the lower flat portion B, and the belt pressing roller 36, that serves as the belt pressing member, thereby achieving a significantly more simplified configuration.

More specifically, in this exemplary embodiment, the driven roller 32 can shift along a substantially same direction as the sheet feeding direction, and therefore the limitation in the layout of the device can be lesser.

Figure 9:
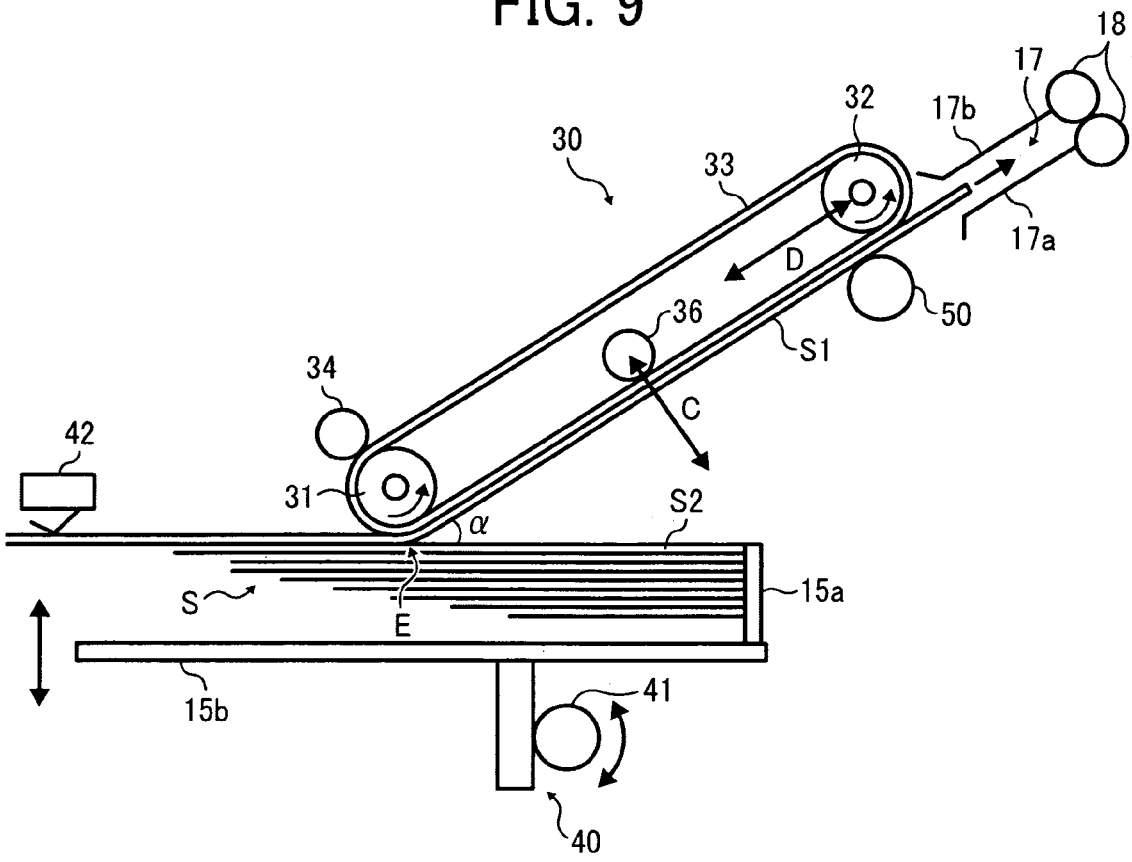
FIG. 9 is a side view of the sheet feeding device with a sheet conveyance roller added thereto.

FIG. 9 illustrates a side view of another example of the sheet feeder 30.

As illustrated in FIG. 9, in this exemplary embodiment, the sheet feeder 30 may further include a conveyance roller 50 that serves as an additional sheet feeding member that rotates with the dielectric belt 33. The conveyance roller 50 is disposed facing the driven roller 32 with the dielectric belt 33 interposed therebetween at the downstream area of the lower flat portion B of the dielectric belt 33. The conveyance roller 50 can sandwich the uppermost sheet S1 with the driven roller 32 at the downstream area of the lower flat portion B, thereby enhancing stable conveyance of the uppermost sheet S1 reliably.

Further, in this exemplary embodiment, the belt pressing roller 36 contacts the inner loop of the dielectric belt 33 when the belt pressing roller 36 is shifted by the belt moving motor 105 from the sheet separating position to the sheet attracting position along the guide rail 37*c*. When the belt pressing roller 36 contacts the inner loop of the dielectric belt 33, it is likely that the driving load along with the rotation of the dielectric belt 33 can increase. However, since the belt pressing roller 36 rotates with the dielectric belt 33, the driving load may be reduced, that is, may not be affected significantly.

In this exemplary embodiment, the sheet feeder 30 includes the dielectric belt 33 that includes the surface charged from outside, but is not limited thereto. For example, instead of the dielectric belt 33, the sheet feeder 30 can employ a dielectric belt 233 that has a structure as shown in FIG. 10.

Figure 10:
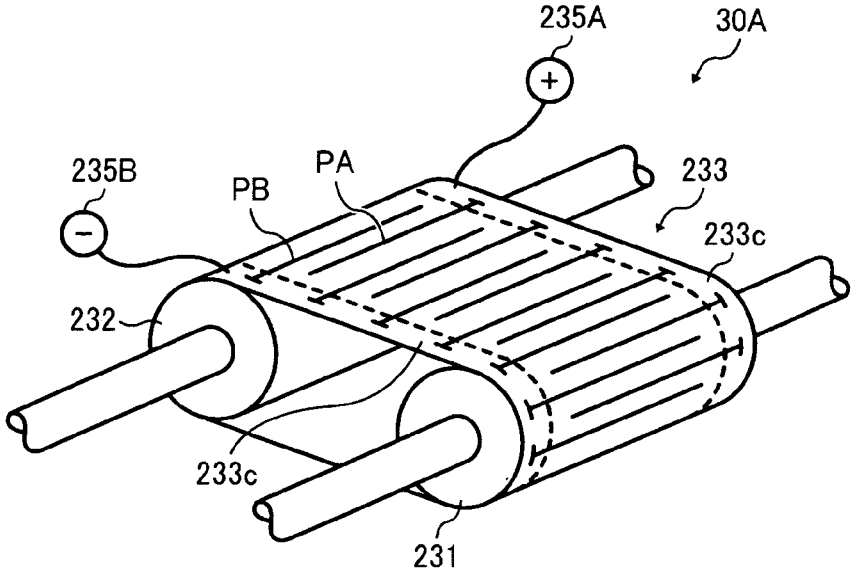
FIG. 10 is a perspective view of another example of potential patterns formed by an electric potential pattern forming unit according to the present patent application.

FIG. 10 is a perspective view of a sheet feeder 30A according to another exemplary embodiment. As illustrated in FIG. 10, the sheet feeder 30A includes a dielectric belt 233 that is looped around a drive roller 231 and a driven roller 232. The dielectric belt 233 has a surface on or inside which a comb-shaped positive potential holding section PA and a comb-shaped negative potential holding section PB are arranged alternately in the sheet feeding direction on the surface of the dielectric belt 233. An alternating current (A/C) power supply 235A applies a positive voltage to the positive potential holding section PA and an alternating current (A/C) power supply 235B applies a negative voltage to the negative potential holding section PB. Power receiving portions 233*c* are exposed on edges in the width direction of the dielectric belt 233 on the surface of the dielectric belt 233 to receive the voltage applied from the A/C power supplies 235A and 235B through the power receiving portions 233*c* to the positive potential holding section PA and the negative potential holding section PB.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present patent application are possible in light of the above teachings. It is therefore to be understood that the invention may be practiced otherwise than as specifically described herein.

What is claimed is:

1. An image forming apparatus, comprising:

an image forming device to form an image on a surface of a sheet;

a sheet feeding unit to feed the sheet to the image forming device, the sheet feeding unit including:

an endless, dielectric belt disposed facing an upper surface of a sheet stack including an uppermost sheet of multiple sheets to contact and attract the uppermost sheet to a surface thereof and feed in a sheet feeding direction as the dielectric belt rotates; and an electric potential pattern forming unit to form an electric potential pattern on a surface of the dielectric belt having multiple potential holding sections of opposite polarities disposed adjacent to each other;

a belt pressing member movably disposed in contact with an inner surface of a flat portion of the dielectric belt to press the dielectric belt outwardly, an outer surface of the flat portion of the dielectric belt facing and contacting the upper surface of the sheet stack; and a moving unit to move the belt pressing member between a sheet attracting position, at which an upstream part of the flat portion of the dielectric belt faces parallel to the upper surface of the sheet stack and a downstream part of the flat portion of the dielectric belt being non-parallel in relation to the upper surface of the sheet stack while being pressed outwardly by the belt pressing member, and a sheet feeding position, at which both the upstream and the downstream parts of the flat portion of the dielectric belt are configured in a flat, parallel manner, the upstream part of the flat portion of the dielectric belt attracting a leading area of the uppermost sheet at the sheet attracting position, the moving unit moving the belt pressing member to the sheet feeding position, and the flat portion of the dielectric belt feeding the uppermost sheet in the sheet feeding direction while carrying the uppermost sheet thereon as the dielectric belt rotates, the flat portion of the dielectric belt is tensioned by a first supporting member fixedly disposed to rotate the dielectric belt and a second supporting member movably disposed downstream from the first supporting member in the sheet feeding direction and rotated together with the first supporting member, and the second supporting member being moved towards the upstream part of the flat portion of the dielectric belt when the belt pressing member is in the sheet attracting position.

2. The image forming apparatus according to claim 1, further comprising a position changing mechanism to change a position of the second supporting member to retain a constant length of the dielectric belt as the belt pressing member moves between the sheet attracting position and the sheet feeding position.

3. The image forming apparatus according to claim 2, wherein the position changing mechanism moves the second supporting member in a direction opposite to the sheet feeding direction.

4. The image forming apparatus according to claim 3, wherein when the belt pressing member moves outwardly from the sheet feeding position to the sheet attracting position, the belt pressing member moves along a guide rail to press the dielectric belt outwardly.

5. The image forming apparatus according to claim 4, wherein the upstream part and the downstream part of the dielectric belt are approximately equally spaced apart with respect to each other.

6. The image forming apparatus according to claim 3, wherein the second supporting member moves to an upstream side of the sheet feeding direction when the belt pressing member is in the sheet attracting position.

7. The image forming apparatus according to claim 2, wherein the position changing mechanism comprises:

a biasing member to urge the second supporting member to a downstream side in the sheet feeding direction;

a first guide member to guide the second supporting member to move between the sheet attracting position and the sheet feeding position; and a second guide member to guide the belt pressing member to move between the sheet attracting position and the sheet feeding position, the second supporting member slidably moves along the first guide member as the belt pressing member moves along the second guide member between the sheet attracting position and the sheet feeding position to retain the constant length of the dielectric belt.

8. The image forming apparatus according to claim 7, wherein the second guide member is located on an inner side of the dielectric belt.

9. The image forming apparatus according to claim 7, wherein the second guide member is located on an outer side of the dielectric belt.

10. The image forming apparatus according to claim 2, wherein the flat portion of the dielectric belt includes:

the upstream part ranging in the sheet feeding direction from a downstream contact area where the first supporting member contacts the inner loop of the dielectric belt to a contact point where the belt pressing member contacts the inner loop of the dielectric belt; and the downstream part ranging in the sheet feeding direction from the contact point of the belt pressing member to the dielectric belt to an upstream contact area where the second supporting member contacts the inner loop of the dielectric belt.

11. The image forming apparatus according to claim 2, wherein at the sheet attracting position, the second supporting member is not lowered to contact the sheet.

12. The image forming apparatus according to claim 1, further comprising an additional sheet feeding member disposed at a substantially downstream end of the flat portion of the dielectric belt, to rotate with the dielectric belt while the uppermost sheet is sandwiched between an additional sheet feeding member and the dielectric belt.

13. The image forming apparatus according to claim 1, wherein the belt pressing member rotates with the dielectric belt and contacts the inner surface of the dielectric belt when the moving unit moves the belt pressing member to the sheet feeding position.

* * * * *